US008203092B2

(12) United States Patent
Chen

(10) Patent No.: US 8,203,092 B2
(45) Date of Patent: Jun. 19, 2012

(54) KEYPAD STRUCTURE

(75) Inventor: Chih-Chao Chen, Taoyuan (TW)

(73) Assignee: Ichia Technologies, Inc., Hwa-Ya Tech. Park, Gueishan, Taoyuan (TW)

( * ) Notice: Subject to any disclaimer, the term of this patent is extended or adjusted under 35 U.S.C. 154(b) by 227 days.

(21) Appl. No.: 12/834,909

(22) Filed: Jul. 13, 2010

(65) Prior Publication Data

US 2011/0220477 A1 Sep. 15, 2011

(30) Foreign Application Priority Data

Mar. 15, 2010 (TW) ..... 99204497 U

(51) Int. Cl.
*H01H 9/00* (2006.01)

(52) U.S. Cl. ..... 200/314

(58) Field of Classification Search ..... 200/310–314, 200/317, 341–345, 512–520; 362/626
See application file for complete search history.

(56) References Cited

U.S. PATENT DOCUMENTS 7,498,534 B2 * 3/2009 Hoyle ..... 200/314
7,663,071 B2 * 2/2010 Chang ..... 200/345
7,777,144 B2 * 8/2010 Wu et al. ..... 200/313

* cited by examiner

*Primary Examiner* — Edwin A. Leon
(74) *Attorney, Agent, or Firm* — Winston Hsu; Scott Margo

(57) ABSTRACT

A keypad structure with a backlight source includes a base, a light guiding plate, a thin film circuit board, a resilient component, a keycap, and an elevating mechanism. The thin film circuit board includes at least one exhausting notch for increasing exhaust as the resilient component is compressed. A plurality of microstructures is formed on the light guiding plate, and the keypad structure further includes a transparent layer formed on the keycap. Light emitted from the backlight source and refracted by the plurality of microstructures passes through the keycap and the transparent layer as the backlight source lights the lateral side of the light guiding plate, so as to illuminate the transparent layer. Thus, the present invention has advantages of illuminating pattern, regional illumination, and preferable comfort.

10 Claims, 10 Drawing Sheets

KEYPAD STRUCTURE

BACKGROUND OF THE INVENTION

1. Field of the Invention

The present invention relates to a keypad structure, and more particularly, to a keypad structure including a plurality of microstructures for refracting light and having advantages of transparent patterns, regional illumination, and comfort operation.

2. Description of the Prior Art

Patterns and characters are conventionally formed on a keypad structure by a printing method. The keypad structure does not include a light source, and the patterns and the characters on the keypad structure are not transparent, so that a user can not distinguish the patterns and the characters on the keypad structure in a dark surrounding. In addition, there is no exhausting notch disposed between a resilient component of a keycap and a circuit board of the conventional keypad structure, so that operation of the keypad structure is uncomfortable due to air resistance generated as the resilient component is compressed. Thus, design of a new-typed keypad structure for solving the above-mentioned drawbacks is an important issue in the electronic industry.

SUMMARY OF THE INVENTION

The present invention provides a keypad structure including a plurality of microstructures for refracting light and having advantages of transparent patterns, regional illumination, and comfort operation for solving above drawbacks.

According to the claimed invention, a keypad structure includes a light guiding plate disposed on a lateral side of a backlight source, and a plurality of microstructures is formed on a low surface of the light guiding plate. The keypad structure further includes a base disposed on an upper surface of the light guiding plate, and a thin film circuit board disposed on the base. The thin film circuit board includes at least one exhausting notch. The keypad structure further includes a resilient component disposed on the thin film circuit board, and the resilient component includes a touch portion. The keypad structure further includes a keycap disposed above the resilient component, and the keycap is made of transparent material. The keypad structure further includes a transparent layer formed on the keycap, and light emitted from the backlight source and refracted by the plurality of microstructures passes through the keycap and the transparent layer as the backlight source lights the lateral side of the light guiding plate. The keypad structure further includes an elevating mechanism installed between the keycap and the resilient component for guiding the keycap to move relative to the base.

Thereby, the plurality of microstructures refracts the light emitted from the backlight source 70 on the lateral side of the light guiding plate to the keycap, so as to illuminate a pattern or a character on the keycap for clear illumination.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
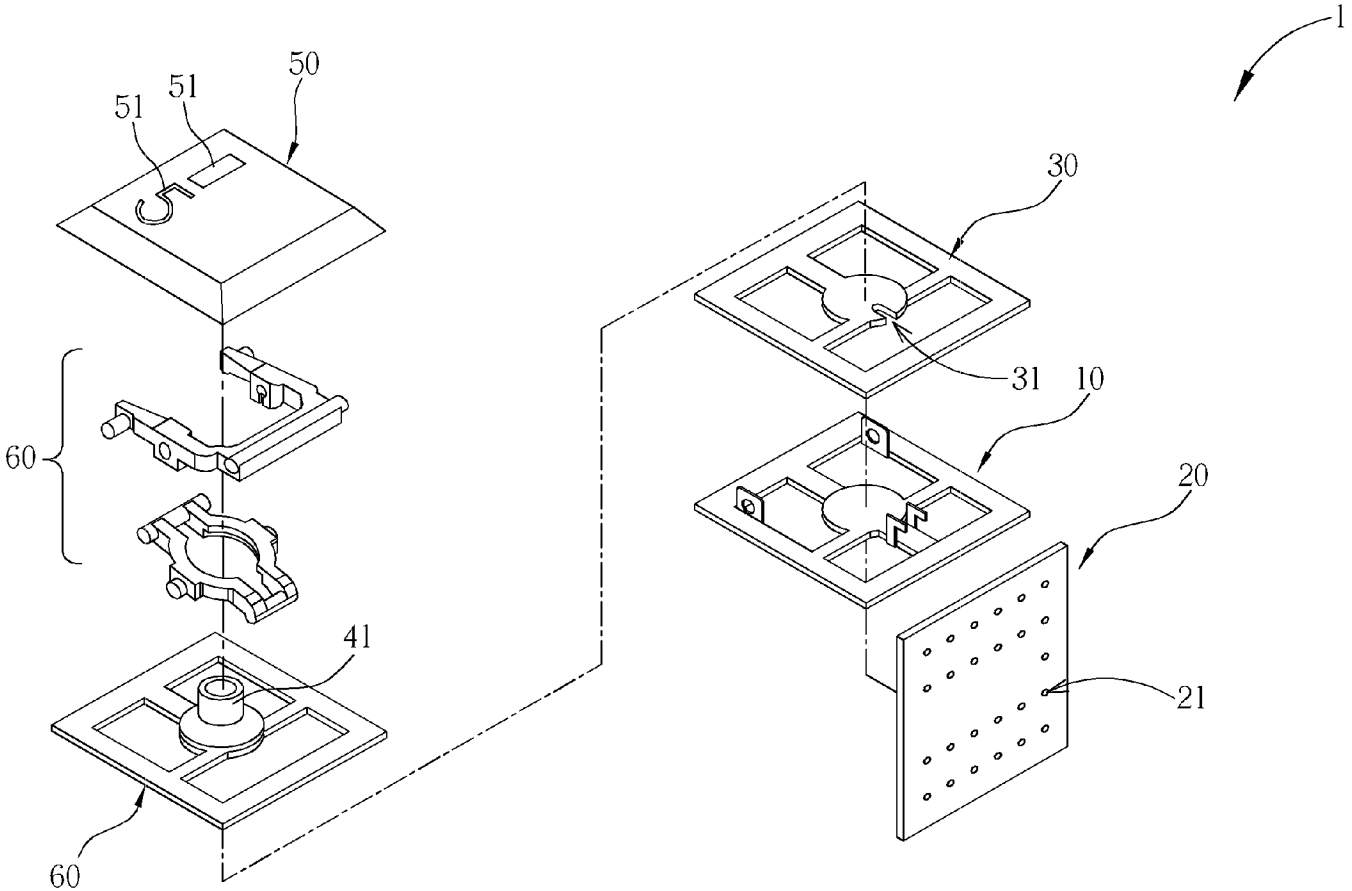
FIG. 1 is an exploded diagram of a keypad structure according to a preferred embodiment of the present invention.
Figure 2:
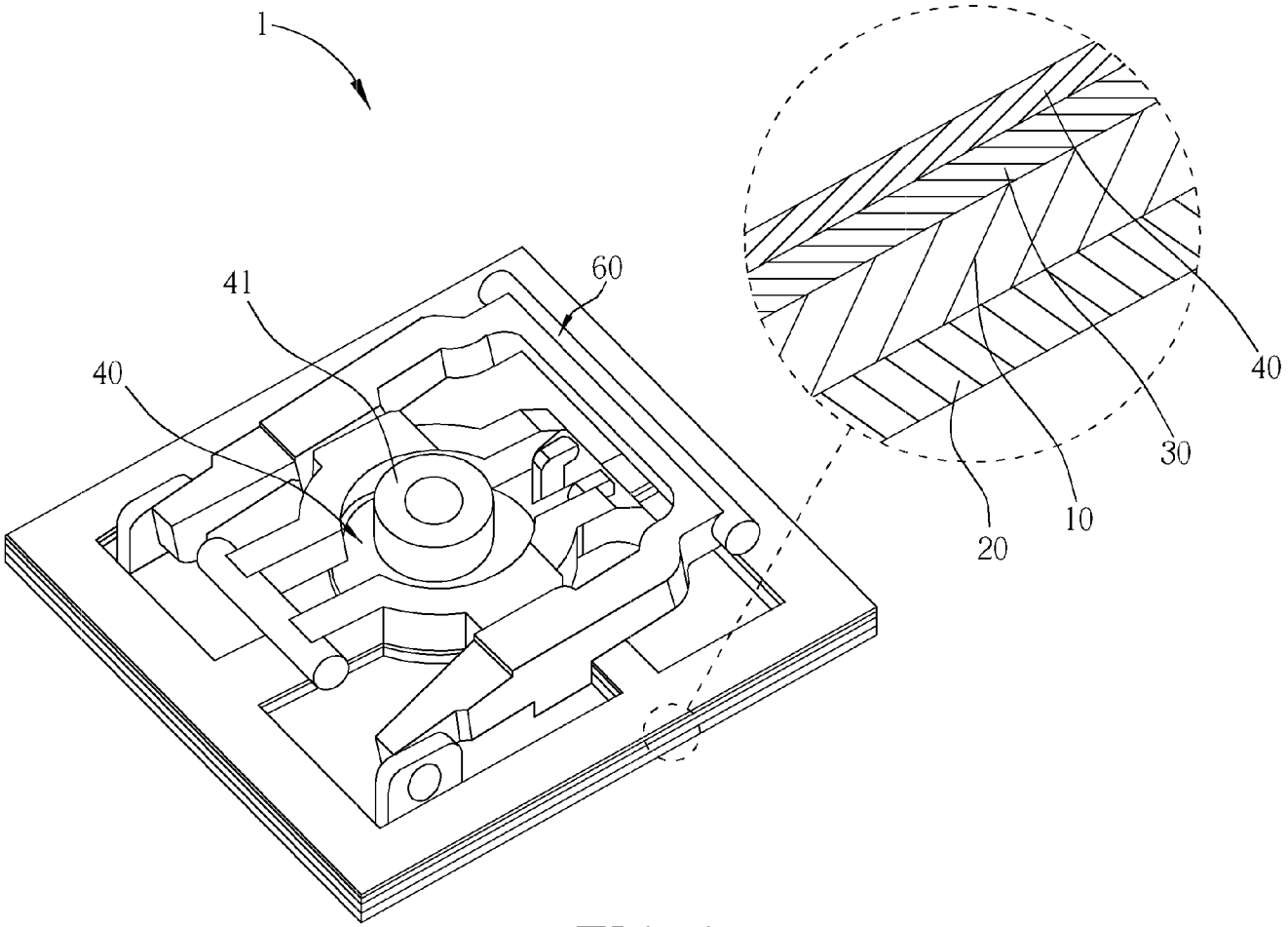
FIG. 2 is an assembly diagram of the keypad structure according to the preferred embodiment of the present invention.

Please refer to FIG. 1 and FIG. 2. FIG. 1 is an exploded diagram of a keypad structure 1 according to a preferred embodiment of the present invention. FIG. 2 is an assembly diagram of the keypad structure 1 according to the preferred embodiment of the present invention. The keypad structure 1 includes a base 10, and a light guiding plate 20 disposed on a lateral side of a backlight source 70. The base 10 is disposed on an upper surface of the light guiding plate 20, and a plurality of microstructures 21 is disposed on a low surface of the light guiding plate 20. The keypad structure 1 further includes a thin film circuit board 30 disposed on the base 10, and the thin film circuit board 30 includes at least one exhausting notch 31. The keypad structure 1 further includes a resilient component 40 disposed on the thin film circuit board 30, and the resilient component 40 includes a touch portion 41. The keypad structure 1 further includes a keycap 50 disposed above the resilient component 40, and the keycap 50 can be made of transparent material. The keypad structure 1 further includes a transparent layer 51 formed on the keycap 50. The keypad structure 1 further includes an elevating mechanism 60 disposed between the keycap 50 and the resilient component 40 for guiding the keycap 50 to move relative to the base 10. The elevating mechanism 60 keeps the keycap 50 horizontally in a pressing process for preventing the keycap 50 from inclination. Thus, when light 71 emitted from the backlight source 70 lights a lateral side of the light guiding plate 20, the light 71 refracted by the plurality of microstructures 21 passes through the keycap 50 for illuminating the transparent layer 51.

Figure 3:
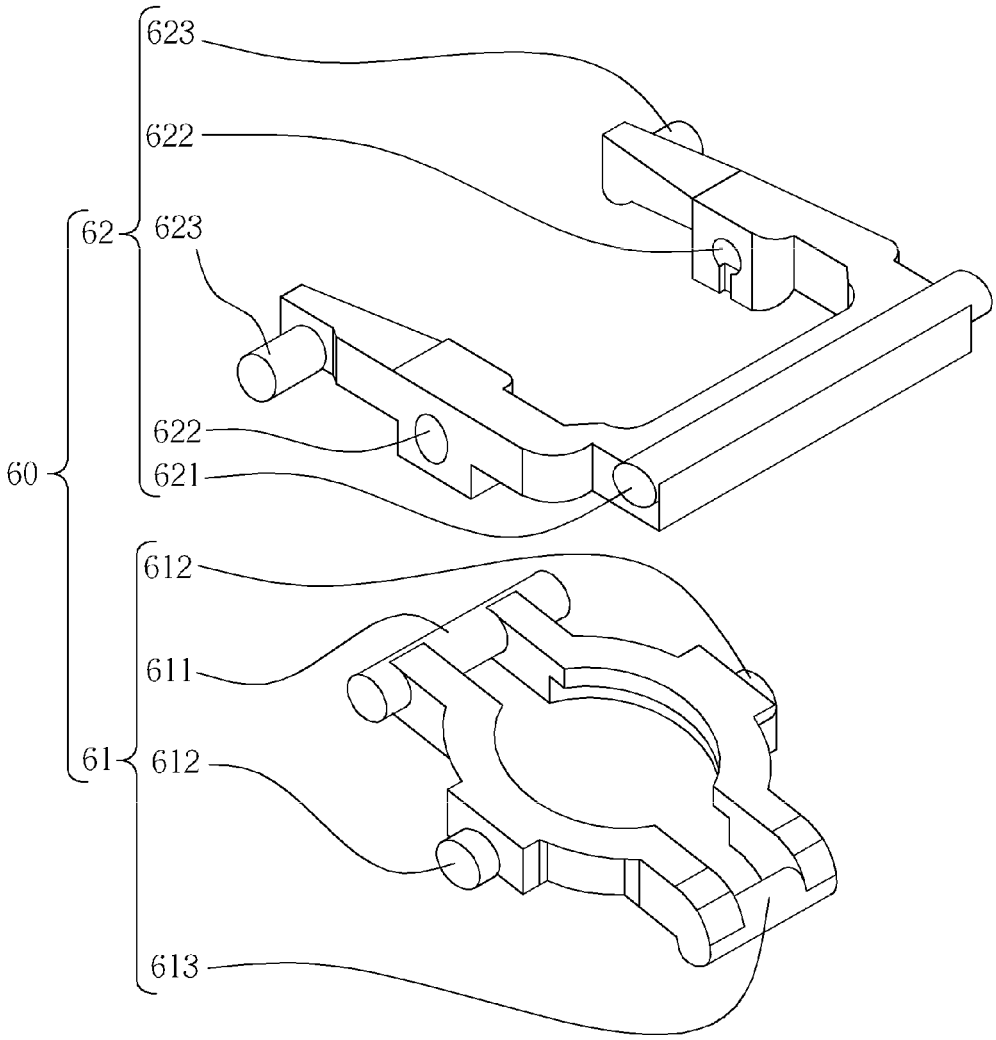
FIG. 3 is a diagram of an elevating mechanism according to the preferred embodiment of the present invention.
Figure 4:
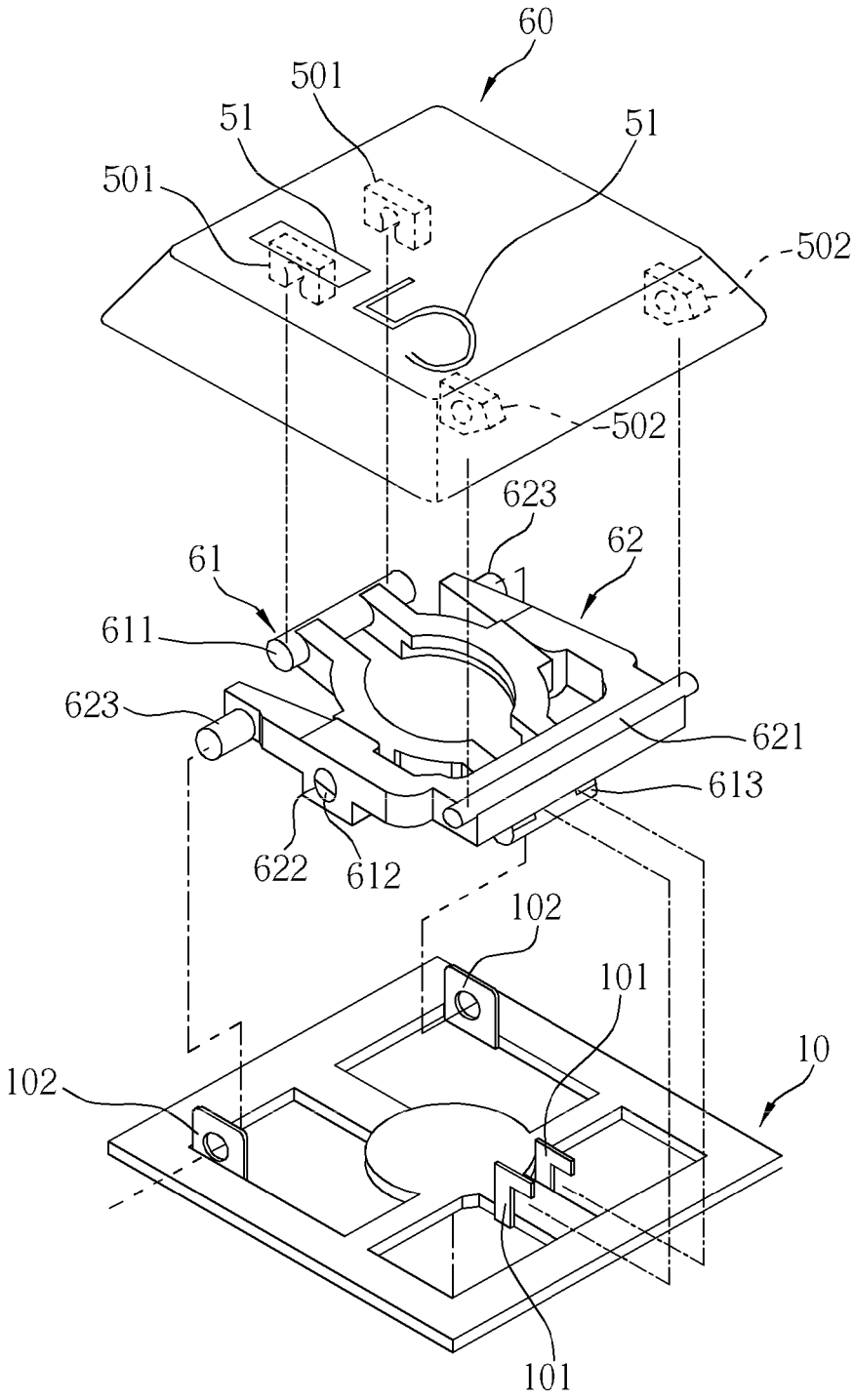
FIG. 4 is an exploded diagram of the elevating mechanism according to the preferred embodiment of the present invention.

Please refer to FIG. 3 and FIG. 4. FIG. 3 is a diagram of the elevating mechanism 60 according to the preferred embodiment of the present invention. FIG. 4 is an exploded diagram of the elevating mechanism 60 according to the preferred embodiment of the present invention. The elevating mechanism 60 includes a first frame 61 and a second frame 62. The first frame 61 includes a wedging rod 611, a pair of pivoting protrusions 612, and a first pivoting portion 613. The second frame 62 includes a sliding rod 621, a pair of pivoting holes 622, and a pair of second pivoting portions 623. The pair of pivoting protrusions 612 is pivoted to the pair of pivoting holes 622. In addition, the keycap 50 includes a pair of wedging slots 501 and a pair of sliding slots 502, and the base 10 includes a pair of first pivoting parts 101 and a pair of second pivoting parts 102, so that two ends of the wedging rod 611 are respectively wedged inside the pair of wedging slots 501, two ends of the sliding rod 621 are respectively pivoted to the pair of sliding slots 592, two ends of the first pivoting portion 613 are respectively pivoted to the pair of first pivoting parts 101, and the pair of second pivoting portions 623 is respectively pivoted to the pair of second pivoting parts 102.

Figure 5:
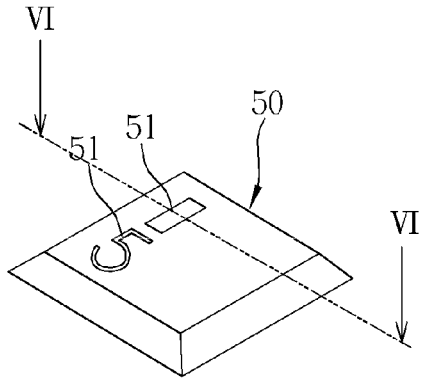
FIG. 5 is a diagram of a keycap according to the embodiment of the present invention.
Figure 6:
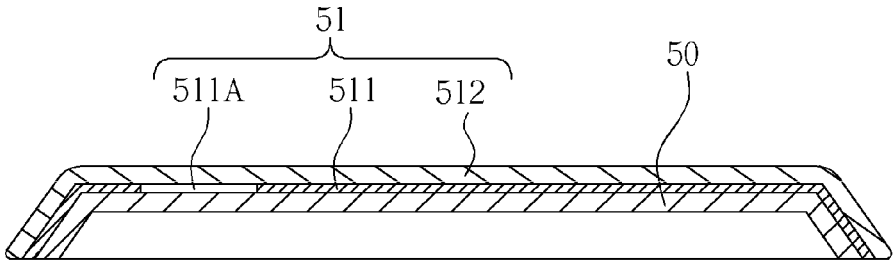
FIG. 6 is a sectional view of the keycap along the VI-VI line shown in FIG. 5.
Figure 7:
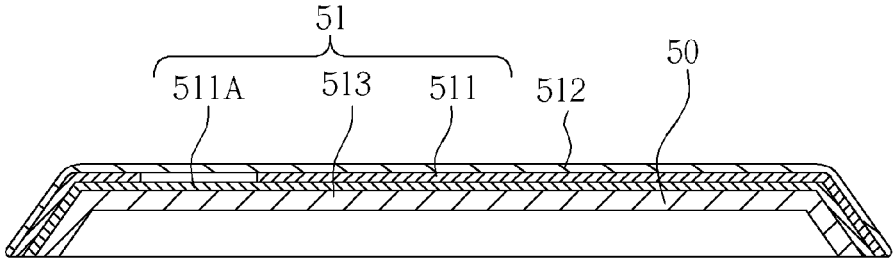
FIG. 7 is a sectional view of the keycap according to the other embodiment of the present invention.

Additionally, the keycap 50 can be made of transparent material or translucent material. Please refer to FIG. 5 and FIG. 6. FIG. 5 is a diagram of the keycap 50 according to the embodiment of the present invention. FIG. 6 is a sectional view of the keycap 50 along the VI-VI line shown in FIG. 5. The transparent layer 51 includes a masking layer 511 and a protection layer 512 covering the masking layer 511 for protection. The masking layer 511 and the protection layer 512 can be formed by coating. The masking layer 511 includes an aperture 511A. The masking layer 511 blocks the light, except that the aperture 511A is for passing the light therethrough. For example, a shape of the aperture 511A is a pattern of the transparent layer 51. The protection layer 512 can be made of transparent film. Please refer to FIG. 7. FIG. 7 is a sectional view of the keycap 50 according to another embodiment of the present invention. The transparent layer 51 can further include a transparent bottom coating layer 513 for increasing adhesion of the masking layer 511 on the keycap 50, and the masking layer 511 is disposed between the protection layer 512 and the bottom coating layer 513.

Figure 8A:
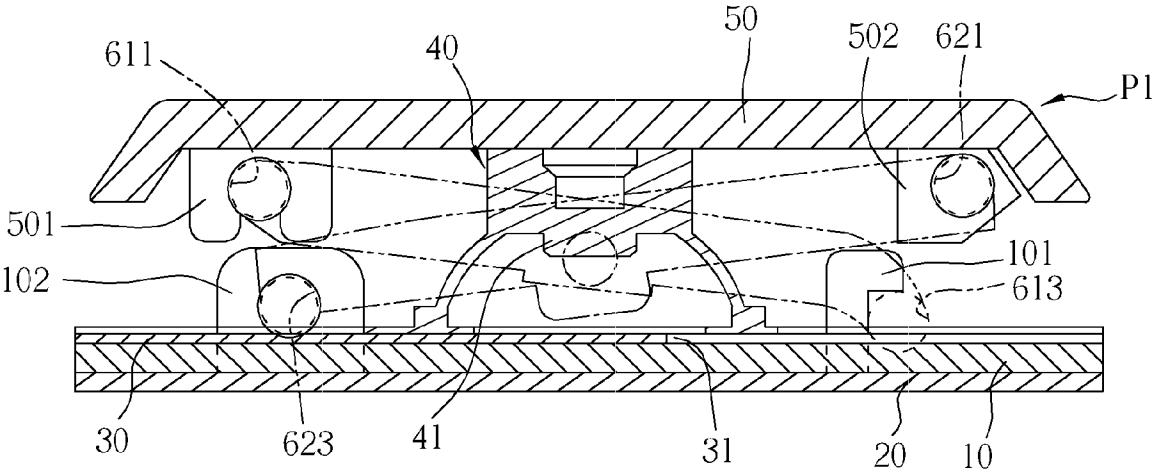
FIG. 8A is a diagram of the keycap not being pressed at a first position according to the embodiment of the present invention.
Figure 8B:
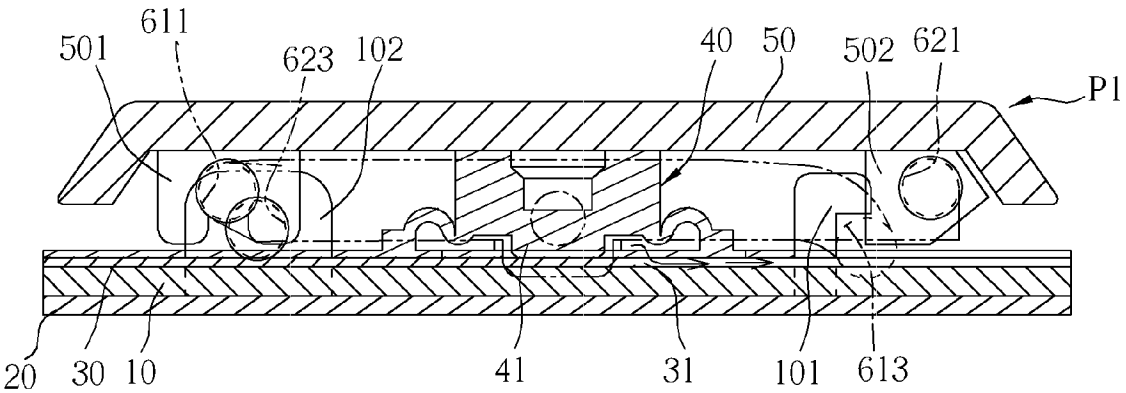
FIG. 8B is a diagram of the keycap being pressed at a second position according to the embodiment of the present invention.

Please refer to FIG. 8A and FIG. 8B. FIG. 8A is a diagram of the keycap 50 not being pressed at a first position P1 according to the embodiment of the present invention. FIG. 8B is a diagram of the keycap 50 being pressed at a second position P2 according to the embodiment of the present invention. As shown in FIG. 8A, when the keycap 50 is not pressed, the keycap 50 is at the first position P1 and the resilient component 40 is separated from the thin film circuit board 30. As shown in FIG. 8B, the keycap 50 is pressed to move from the first position P1 to the second position P2, so that the resilient component 40 is compressed and the touch portion 41 contacts the thin film circuit board 30 for outputting an electrical signal. As the keycap 50 is released, a resilient force of the resilient component 40 moves the touch portion 41 away from the thin film circuit board 30 so as to push the keycap 50 to recover to the first position P1, which means the keycap 50 moves from the second position P2 shown in FIG. 8B to the first position P1 shown in FIG. 8A.

Figure 9:
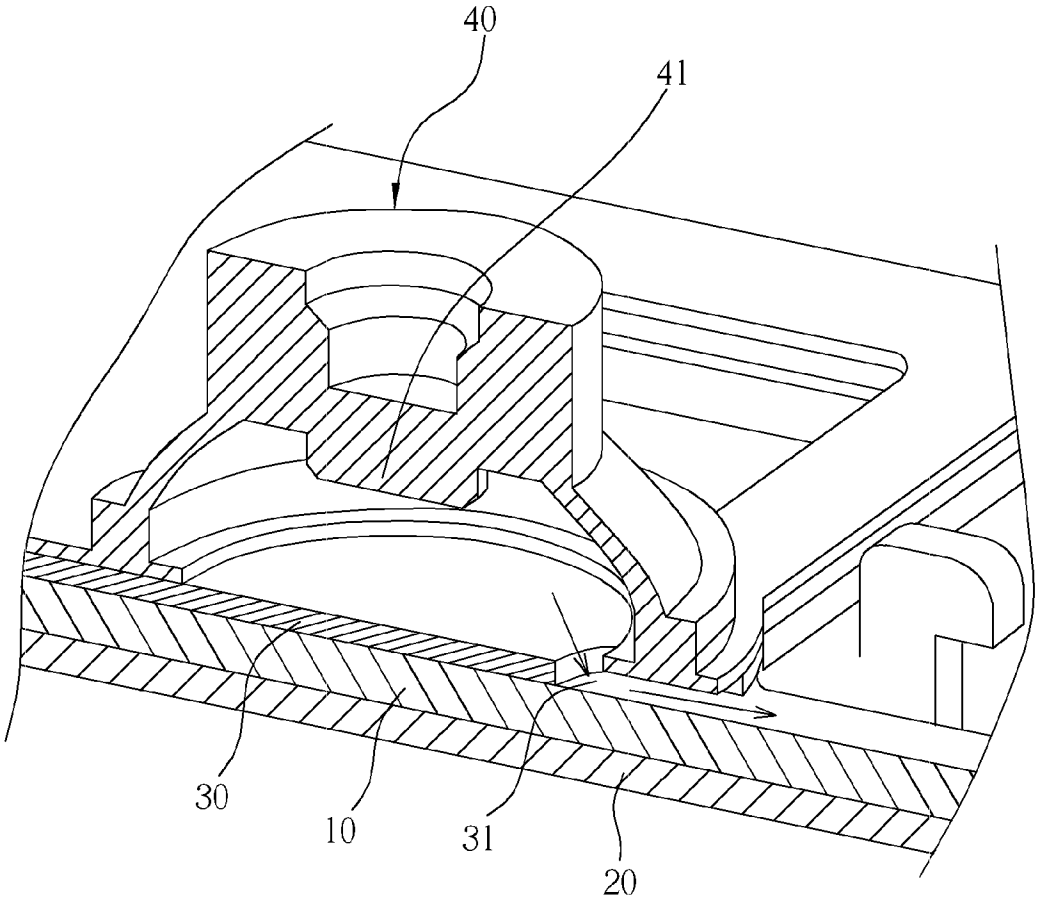
FIG. 9 is a sectional view of the keypad structure according to the embodiment of the present invention.
Figure 10A:
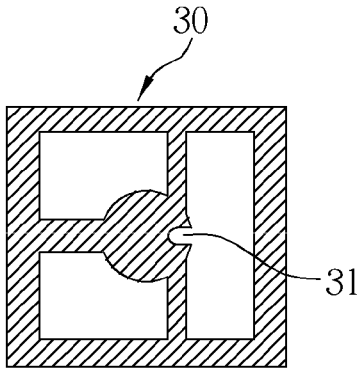
FIG. 10A to FIG. 10D are diagrams of an exhausting notch with different shapes according to the embodiment of the present invention.
Figure 10B:
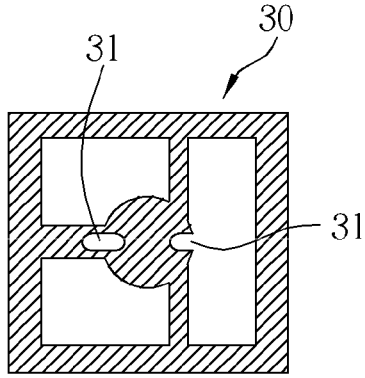
Figure 10C:
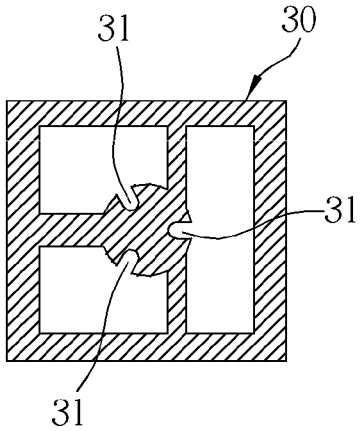
Figure 10D:
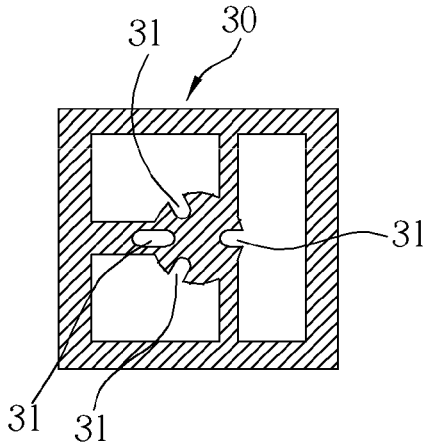

Please refer to FIG. 9, FIG. 10A, FIG. 10B, FIG. 10C, and FIG. 10D. FIG. 9 is a sectional view of the keypad structure 1 according to the embodiment of the present invention. FIG. 10A to FIG. 10D are diagrams of the exhausting notch 31 with different shapes according to the embodiment of the present invention. The exhausting notch 31 of the thin film circuit board 30 can speed air exhaustion of the resilient component 40, so as to decrease the air resistance during air compression for preferable comfort operation. As shown in FIG. 10A, FIG. 10B, FIG. 10C, and FIG. 10D, the exhausting notch 31 of the thin film circuit board 30 can be a single-slot shape, a dual-slot shape, a tri-slot shape, or a quad-slot shape, and it depends on actual demand.

Figure 11:
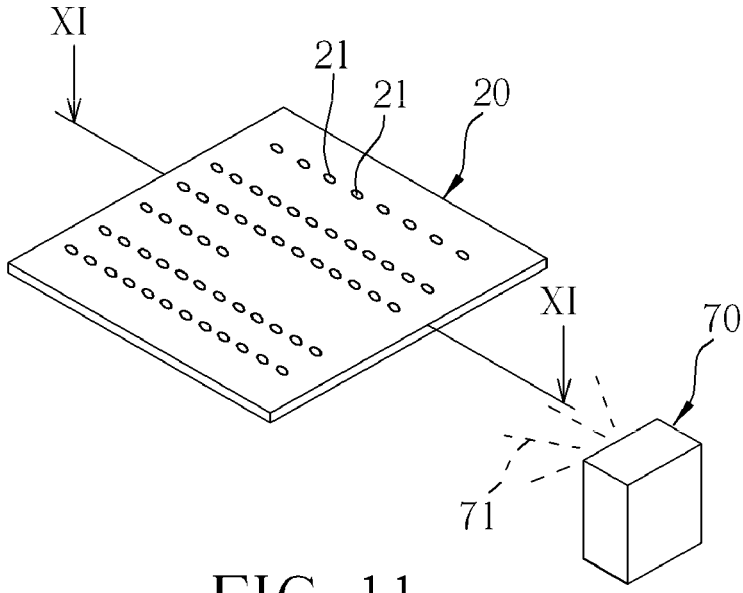
FIG. 11 and FIG. 12 are diagrams of a light guiding plate in different views according to the embodiment of the present invention.
Figure 12:
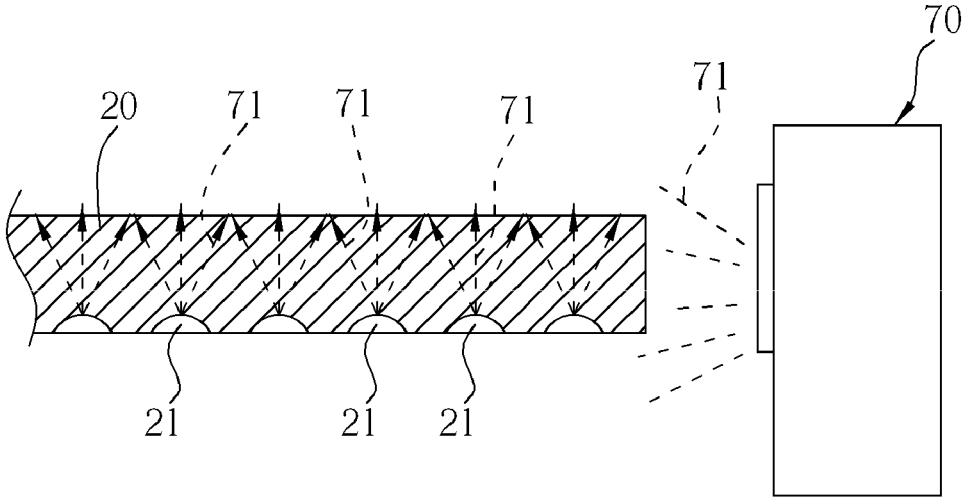

Please refer to FIG. 11 and FIG. 12. FIG. 11 and FIG. 12 are diagrams of the light guiding plate 20 in different views according to the embodiment of the present invention. The plurality of microstructures 21 of the light guiding plate 20 can be a plurality of arc protruding parts. When the light 71 emitted from the backlight source 70 lights at the lateral side of the light guiding plate 20, the light 71 is refracted upward by the microstructures 21, so that the light 71 can pass through the aperture 511A of the transparent layer 51 on the keycap 50, which means the pattern or the character on the keycap 50 is illuminated. Therefore, the light 71 can be emitted by the backlight source 70 at the lateral side of the light guiding plate 20 in a dark surroundings, so as to illuminate the pattern or the character on the keycap 50 for clear discrimination.

Figure 13:
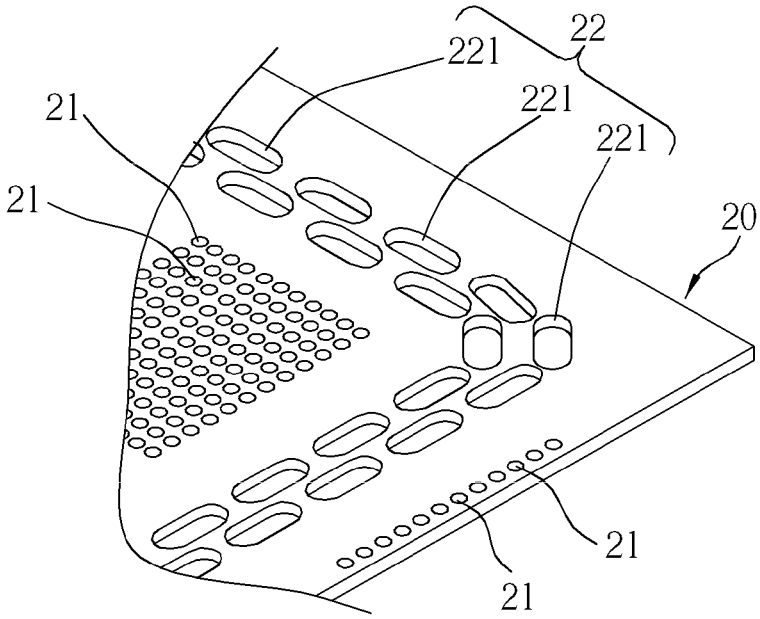
FIG. 13 is a diagram of a light guiding plate according to another embodiment of the present invention.
Figure 14:
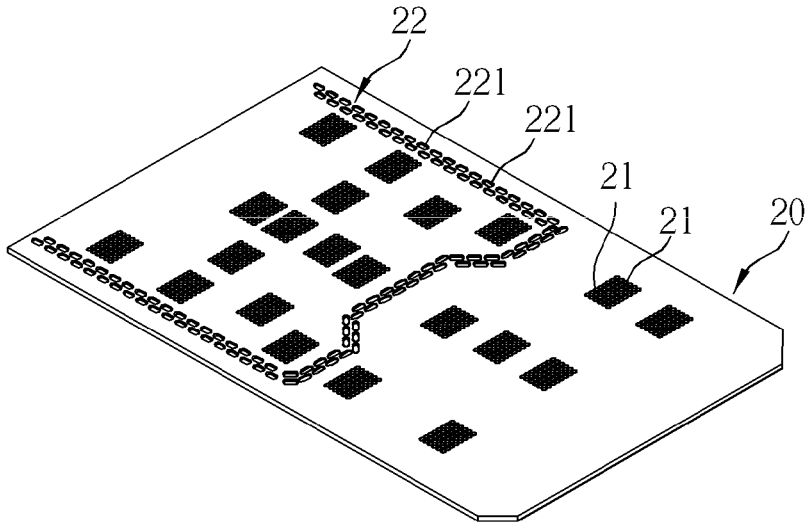
FIG. 14 is a diagram of the light guiding plate shown in FIG. 13 applied in a keyboard.

Please refer to FIG. 13 and FIG. 14. FIG. 13 is a diagram of the light guiding plate 20 according to another embodiment of the present invention. FIG. 14 is a diagram of the light guiding plate 20 shown in FIG. 13 applied in a keyboard. As shown in FIG. 13, the light guiding plate 20 can further include a chain structure 22, and the chain structure 22 includes a plurality of indentations 221. As the backlight source 70 emits the light 71 at the lateral side of the light guiding plate 20, the plurality of indentations 221 can refract the light 71 for regional illumination. As shown in FIG. 14, due to the block of the chain structure 22, the microstructures 21 in a specific region of the light guiding plate 20 can refract the light for regional illumination.

Comparing to the prior art, the present invention can illuminate the pattern or the character on the keycap. The present invention utilizes the plurality of microstructures to refract the light to the pattern or the character on the keycap or to a predetermined region on the keycap, so that the user can operate the keypad structure conveniently in the dark surrounding. In addition, the present invention includes the exhausting notch for exhausting the air inside the resilient component when the resilient component is compressed, so as to decrease the air resistance as the keycap is pressed for preferable comfort operation. Besides, amounts of the exhausting notch can be designed according to the actual demand.

Those skilled in the art will readily observe that numerous modifications and alterations of the device and method may be made while retaining the teachings of the invention.

What is claimed is:

1. A keypad structure comprising:

a light guiding plate disposed on a lateral side of a backlight source, a plurality of microstructures being formed on a low surface of the light guiding plate;

a base disposed on an upper surface of the light guiding plate;

a thin film circuit board disposed on the base, the thin film circuit board comprising at least one exhausting notch;

a resilient component disposed on the thin film circuit board, the resilient component comprising a touch portion;

a keycap disposed above the resilient component, the keycap being made of transparent material;

a transparent layer formed on the keycap, light emitted from the backlight source and refracted by the plurality of microstructures passing through the keycap and the transparent layer as the backlight source lights the lateral side of the light guiding plate; and an elevating mechanism installed between the keycap and the resilient component for guiding the keycap to move relative to the base.

2. The keypad structure of claim 1, wherein the elevating mechanism comprises:

a first frame comprising:

a wedging rod;

a pair of pivoting protrusions; and a first pivoting portion; and a second frame connected to the first frame, the second acting component comprising:

a sliding rod;

a pair of pivoting holes, the pair of pivoting protrusions pivoting inside the pair of pivoting holes; and a pair of second pivoting portions.

3. The keypad structure of claim 2, wherein the keycap comprises a pair of wedging slots and a pair of sliding slots, the base comprises a pair of first pivoting parts and a pair of second pivoting parts, the wedging rod is wedged inside the pair of wedging slots, two ends of the sliding rod are respectively pivoted inside the pair of sliding slots, the first pivoting portion pivots to the pair of first pivoting parts, and the pair of the second pivoting portions pivots to the pair of second pivoting parts.

4. The keypad structure of claim 1, wherein the light guiding plate comprises a chain structure for refracting the light emitted from the backlight source for regional illumination, and the chain structure comprises a plurality of indentations.

5. The keypad structure of claim 1, wherein the thin film circuit board comprises a plurality of exhausting notches.

6. The keypad structure of claim 1, wherein the transparent layer comprises:

a masking layer for blocking the light; and a protection layer covering on the masking layer for protection.

7. The keypad structure of claim 6, wherein the masking layer comprises an aperture for passing the light therethrough.

8. The keypad structure of claim 7, wherein the aperture is made by laser technology.

9. The keypad structure of claim 7, wherein the protection layer is made of transparent film.

10. The keypad structure of claim 7, wherein the transparent layer comprises a transparent bottom coating layer for increasing adhesion on the keypad, and the masking layer is disposed between the protection layer and the transparent bottom coating layer.

* * * * *